United States Patent [19]

Smith

[11] Patent Number: 4,586,640

[45] Date of Patent: May 6, 1986

[54] PRINTING MACHINE FINISHING STATION

[75] Inventor: Charles E. Smith, Pittsford, N.Y.

[73] Assignee: Xerox Corporation, Stamford, Conn.

[21] Appl. No.: 642,910

[22] Filed: Aug. 21, 1984

[51] Int. Cl.[4] ..... G03G 15/00; B42B 5/00; B25C 1/00

[52] U.S. Cl. ..... 227/14; 355/3 SH; 355/14 SH; 412/6; 412/33; 412/37; 270/53

[58] Field of Search ..... 355/3 SH, 14 SH; 270/53; 414/53, 904; 412/6, 8, 33, 36, 37; 227/14; 156/91, 92

[56] References Cited

U.S. PATENT DOCUMENTS

| | | | |
|---|---|---|---|
| 3,793,016 | 2/1974 | Eichorn | 96/1 R |
| 3,794,550 | 2/1974 | Taillie | 161/147 |
| 4,343,673 | 8/1982 | Smith, Jr. et al. | 156/583.4 |
| 4,385,827 | 5/1983 | Naramore | 355/14 SH |

*Primary Examiner*—Arthur T. Grimley
*Assistant Examiner*—C. Romano
*Attorney, Agent, or Firm*—H. Fleischer; J. E. Beck; R. Zibelli

[57] ABSTRACT

An apparatus in which a plurality of sheets are attached to one another to form a booklet thereof. The sheets are compiled to form a set which is then advanced to a stapling apparatus and/or a binding apparatus. The set of sheets may be secured to one another by either stapling, binding, or a combination of both.

11 Claims, 7 Drawing Figures

PRINTING MACHINE FINISHING STATION

This invention relates generally to a printing system, and more particularly concerns an apparatus for attaching a plurality of sheets to one another to form a booklet thereof.

A typical printing system utilizes the process of electrophotographic printing wherein a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In commercial printing systems of the foregoing type, the copy sheet, with the information permanently reproduced thereon, is transported to a compiler. After the requisite number of sheets, corresponding to a set of original documents is compiled, the copies of the set are permanently affixed to one another to form a booklet thereof. The station securing the copies to one another is generally referred to as a finishing station. Hereinbefore, the finishing station generally included a stapling or stitching apparatus, or an adhesive binding apparatus for securing the sheets to one another to form the booklet. Frequently, commercial printing machines utilize a recirculating document handling system to advance successive original documents from a stack thereof to the exposure station for reproduction. When a recirculating document handling system is employed, the printing system produces a large number of copies rapidly. This type of system may be used to form sets of booklets of copies. In order for each set to be bound, it is necessary to either adhesively secure the sheets to one another or to staple the sheets to one another. In some commercial operations, it is not necessary to have a finished bound look to the booklet. Under these circumstances, the copy sheets are stapled or stitched to one another to form the booklet. Alternatively, it may be desirable for the set to have a bound, finished look. Under these latter circumstances, it is desirable to adhesively secure the sheets of the set to one another. Thus, in a high speed printing system it is desirable to have the capability of either adhesively binding the sheets of the set to one another, or stapling the sheets to one another. Moreover, it may be desirable under certain circumstances to be capable of performing both operations, i.e. stapling and adhesively binding the sheets of the set to one another, when it is desirable to obtain a very strong bond. Furthermore, in some applications, it is also desirable to double or triple staple the sheets and apply adhesive tape without applying adhesive binding.

Various approaches have been devised for securing sheets to one another. The following disclosures appear to be relevant:

U.S. Pat. No. 3,793,016, Patentee: Eichorn, Issued: Feb. 19, 1974.

U.S. Pat. No. 3,794,550, Patentee: Taillie, Issued: Feb. 26, 1974.

U.S. Pat. No. 4,343,673, Patentee: Smith, Jr. et al., Issued: Aug. 10, 1982.

The relevant portions of the foregoing disclosures may be briefly summarized as follows:

Eichorn and Taillie describe an electrophotographic printing machine using an adhesive binder and staples. The adhesive is toner particles.

Smith, Jr. et al. describes an electrophotogaphic printing machine having a finishing station which may also include a stitching station.

In accordance with one aspect of the feature of the present invention, there is provided an apparatus for attaching a plurality of sheets to one another to form a booklet thereof. Means receive successive sheets to form a set of sheets. Means are provided for stapling the sheets of the set to one another. Means are also provided for adhesively binding the sheets of the set to one another. Means transport the set of sheets from the receiving means to either the binding means or the stapling means or to both the binding means and the stapling means to form the booklet thereof.

Pursuant to another aspect of the features of the present invention, there is provided a printing system. The printing system has means for reproducing indica on successive sheets. Means advance at least the sheets having indica reproduced thereon along a sheet path. Means receive the sheets advanced along the sheet path to form a set of sheets. Means are provided for stapling the sheets of the set to one another. Means are also provided for adhesively binding the sheets of the set to one another. Means transport the set of sheets from the receiving means to either the binding means or the stapling means or to both the binding means and the stapling means to form the booklet thereof.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
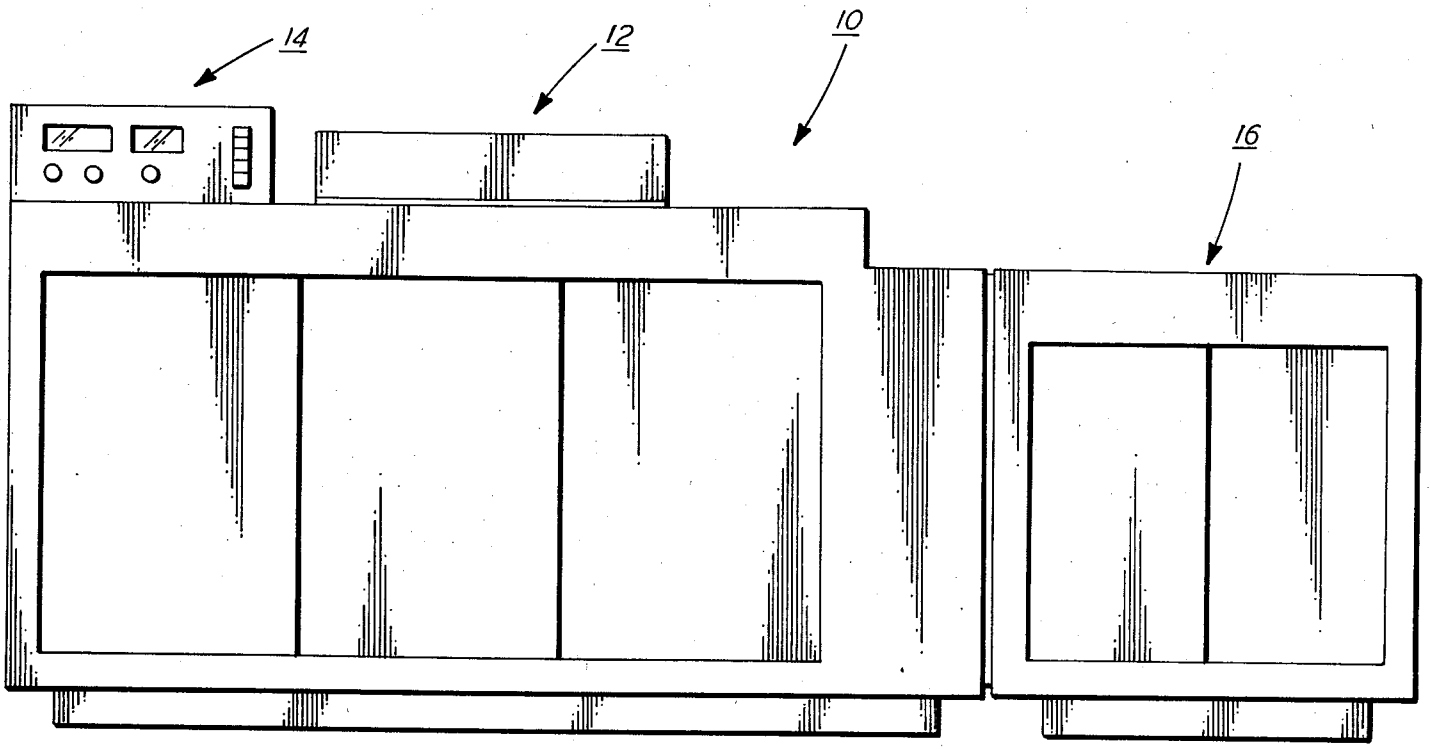
FIG. 1 is a schematic elevational view depicting an illustrative printing system incorporating the finishing station of the present invention therein.

For a general understanding of the features of the present invention, reference is had to the drawings. In the drawings, like reference numerals have been used to identify identical elements. FIG. 1 schematically depicts the printing system of the present invention comprising an electrophotographic printing machine for reproducing copies and a finishing module for forming the completed copy sets. It will become evident from the following discussions that the finishing module is equally well suited for use in a wide variety of printing systems or other types of device with the features thereof not being specifically limited in there application to the particular embodiment depicted herein.

Referring now to FIG. 1 of the drawings, the printing system and its general operation will be described with reference thereto. As shown therein, the electrophotographic printing machine, generally designated by the reference numeral 10, is capable of producing a stream of copy sheets having information copied either on one side only, simplex sheets, or on both sides, duplex sheets. A recirculating document feeder 12 is shown positioned above a platen at the imaging station of printing machine 10. Document feeder 12 is adapted to feed original documents, in a seriatim, to the platen for copying. Usually, document feeder 12 operates in a collating mode in which original documents are fed, in seriatim, from a stack in a tray at the top of the feeder for copying one at a time for each circulation and then return to the stack. The original documents are placed in the feeder in a pre-determined page sequential order. For example, the first page is on top of the stack and the last page is at the bottom of the stack. The last original document is fed to the platen first and then returned to the top of the stack. The machine operator can control operation of the electrophotographic printing machine and its related apparatus through an operator control panel designated generally by the reference numeral 14. To this end, the machine operator can determine whether a set of copies will be stapled, adhesively bound, or have both operations performed thereon. The set of original documents is received in a compiler tray of a finishing module, indicated generally by the reference numeral 16. The completed set of copies sheets or booklet is then advanced through the finishing module to be stapled or adhesively bound, or have a combination of both of the foregoing operations performed thereon. Thus, finishing module 16 includes a stapling apparatus and an adhesive binding apparatus. The foregoing describes generally the operation of the printing system utilizing the finishing module of the present invention therein. Further details of the electrophotographic printing machine and the finishing module will be described with reference to FIGS. 2 through 7, inclusive. It is believed that the foregoing description is sufficient for purposes of the present application to illustrate the general operation of the printing system.

Figure 2:
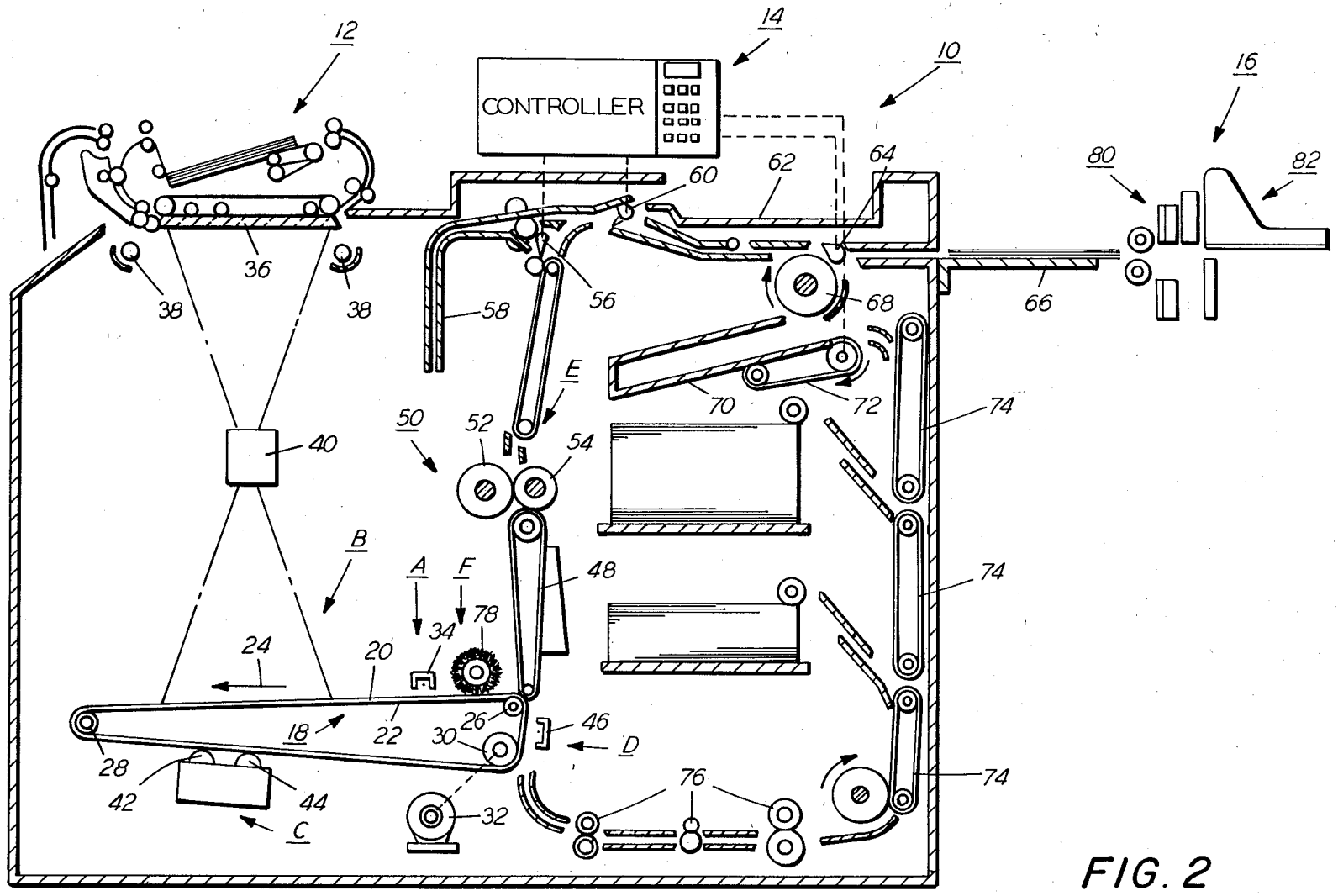
FIG. 2 is a schematic elevational view showing the electrophotographic printing machine and the finishing station of the FIG. 1 printing system.

Referring now to FIG. 2, there is shown the detailed operation of the electrophotographic printing machine. The electrophotographic printing machine employs a belt 18 having a photoconductive surface 20 desposited on a conductive substrate 22. Preferably, photoconductive surface 20 is made from a selenium alloy with conductive substrate 22 being made from an aluminum alloy. Other suitable photoconductive materials, e.g. organic materials, and conductive substrates, e.g. Mylar, a trademark of the DuPont Corporation, may also be employed. Belt 18 moves in the direction of arrow 24 to advance successive portions of photoconductive surface 12 sequentially through the various processing stations disposed about the path of movement thereof. Belt 18 is entrained about stripping roller 26, tensioning roller 28, and drive roller 30. Stripping roller 26 is mounted rotatably, so as to rotate with belt 18. Tensioning roller 28 is resiliently urged against belt 18 to maintain belt 18 under the desired tension. Drive roller 30 is rotated by motor 32 coupled thereto by suitable means, such as a belt drive. As roller 30 rotates, it advances belt 18 in the direction of arrow 24.

Initially, a portion of the photoconductive surface passes through charging station A. At charging station A, a corona generating device, indicated generally by the reference numeral 34 charges photoconductive surface 20 to a relatively high, substantially uniform potential.

Next, the charged portion of photoconductive surface 20 is advanced throught imaging station B. At imaging station B, a document handling unit 12 is positioned over platen 36 of the printing machine. Document handling unit 12 sequentially feeds documents from a stack of documents placed by the operator face up in a normal forward collated order in the document stacking and holding tray. A document feeder located below the tray forwards the bottom document in the stack to a pair of take away rollers. The bottom-most sheet is then fed by the rollers through the document guide to a feed roll pair and belt. The belt, entrained about a pair of opposed space rollers, advances the document onto platen 36. After imaging, the original document is fed from the platen by the belt into guide and feed roll pairs. The document then advances into an inverter mechanism or back to the document stack through the feed roll pairs. A position gate is provided to divert the document either to the inverter or to the feed roll pair. Imaging of a document is achieved by lamps 38 which illuminate the document on platen 36. Light rays reflected from the document are transmitted through lens 40. Lens 40 focuses the light image of the original document onto the charged portion of photoconductive surface 20 of belt 18 to selectively dissipate the charge thereon. This records an electrostatic latent image on photoconductive surface 20 which corresponds to the informational areas contained within the original document. Thereafter, belt 18 advances the electrostatic latent image recorded on photoconductive surface 20 to development station C.

With continued reference to FIG. 2, at development station C, a pair of magnetic brush developer rollers, indicated generally by the reference numerals 42 and 44 advance developer material into contact with the electrostatic latent image. The latent image attracts toner particles from the carrier granules of the developer material to form a toner powder image on the photoconductive surface 20 of belt 18.

Belt 18 then advances the toner image to transfer station D. At transfer station D, a copy sheet is moved into contact with the powder image. Transfer station D includes a corona generating device 46 which sprays ions onto the backside of the copy sheet. This attracts the toner powder image from photoconductive surface 20 to the sheet. After transfer, conveyor 48 advances the sheet to fusing station E.

Fusing station E includes a fuser assembly, indicated generally by the reference numeral 50, which permanently affixes the transferred powder image to the copy sheet. Preferably, fuser assembly 50 includes a heated fuser roller 52 and back-up roller 54 with the powder image contacting fuser roller 52. In this manner, the powder image is permanently affixed to the copy sheet.

After fusing, the copy sheets are fed to gate 56 which functions as an inverter selecter. Depending upon the position of gate 56, the copy sheets will be deflected into sheet inverter 58 or will bypass inverter 58 and be fed directly to second decision gate 60. The sheets which bypass inverter 58 turn a 90° corner in the sheet path before reaching gate 60. At gate 60, the sheet is in a face-up orientation with the image side which has been fused, face-up. If inverter path 58 is selected, the opposite is true, i.e. the last printed side is face-down. Decision gate 60 either deflects the sheet directly into an open output tray 62 or deflects the sheet into a transport path which carries them onto a third decision gate 64. Gate 64 either passes the sheet directly into compiler tray 66 of finishing module 16 or onto a duplex inverter roll 68. Roll 68 inverts and stacks the sheets to be duplexed in duplex tray 70 when gate 64 so directs. Duplex tray 70 provides an intermediate or buffer storage for those sheets which have been printed on one side, and on which an image will be subsequently printed on the second side opposed thereof, i.e. the sheets being duplexed. Due to sheet inverting by roller 68, the buffer sheets are stacked in tray 70 face-down. They are stacked in duplex tray 70 on top of one another in the order in which they are copied.

In order to complete duplex coping, the simplex sheets in tray 70 are fed, in seriatim, by bottom feeder 72 from tray 70 back to transfer station D via conveyor 74 and rollers 76 for transfer of the toner powder image to the opposed side of the copy sheet. Inasmuch as the bottom most sheet is fed from duplex sheet tray 70, the proper or clean side of the copy sheet is positioned in contact with belt 18 at transfer station D so that the toner powder image is transferred thereto. The duplex sheet is then fed through the same path as the simplex sheet to be stacked in tray 62 or, when the finishing operation is selected, in tray 66.

Invariably, after the copy sheet is separated from photoconductive surface 20 of belt 18, some residual particles remain adhering thereto. These residual particles are removed from photoconductive surface 20 at cleaning station F. Cleaning station F includes a rotatably mounted fiberous or electrostatic brush 78 in contact with photoconductive surface 20 of belt 18. The particles are cleaned from photoconductive surface 20 of belt 18 by the rotation of brush 78 in contact therewith. Subsequent to cleaning, a discharge lamp (not shown) floods photoconductive surface 20 with light to dissipate any residual electrostatic charge remaining thereon prior to the charging thereof for the next successive imaging cycle.

Controller 14 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine console selected by the operator. Conventional sheet path sensors or switches may be utilized for keeping track of the position of the document and the copy sheets. In addition, controller 14 regulates the various positions of the decision gates depending upon the mode of operation selected. Thus, when the operator selects the finishing mode, either adhesive binding apparatus 80 and/or stapling apparatus 82 wil be energized and the decision gates will be oriented so as to advance either the simplex or duplex copy sheet to compiler tray 66. The detailed operation of finishing module 16 will be described hereinafter with reference to FIGS. 3 through 7, inclusive.

Figure 3:
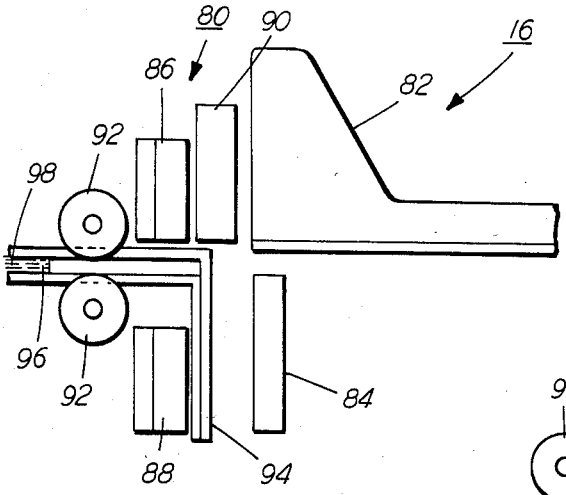
FIG. 3 is an elevational view depicting, in greater detail, the finishing station with the set of sheets being gripped thereat.

Referring now to FIG. 3, the general operation of finishing module 16 will now be described. Finishing module 16 combines the binding and stapling, or stitching, functions of an on-line finisher in the same path from compiler to stacker. The binding and stapling hardware are co-linear options, and either or both or neither may be energized. Finishing module 16 includes a stapler 82 having a clincher 84 associated therewith. In addition, adhesive binder 80 is in line with stapler 82 and clincher 84. Adhesive binder 80 includes clamps 86 and 88 for securing the stack of sheets during the adhesive binding operation. Adhesive binder 80 also includes a retracting binder and tape folder 90. Eject rolls 92 are employed to forward the adhesively bound, stapled or both stapled and adhesively bound booklet to a stacker. At the stacker, the completed booklet is removed from the printing system by the operator. A gripper 94 has long jaws which can pass through the retracted binding clamps 86 and 88. Gripper 94 transports the set of copy sheets either to binding station 80 or stapling station 82. Gripper 94 returns under the set of copy sheets for stapling. For binding, gripper 94 waits for the set to be bound and ejected before returning to receive the next set of copy sheets. In FIG. 3, gripper 94 is shown grasping the leading marginal region 96 of a stack of copy sheets 98 in compiler tray 66 (FIG. 2).

Figure 4:
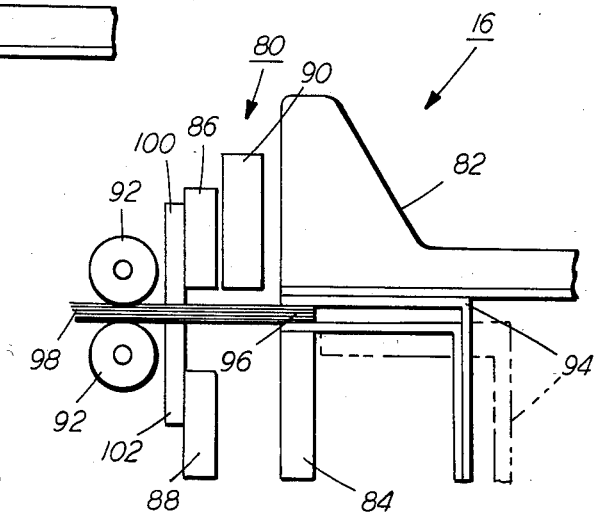
FIG. 4 is a schematic elevational view depicting, in greater detail, the set of sheets at the stapling apparatus of the finishing station.

Turning now to FIG. 4, there is shown gripper 94 advancing stack 98 so that the leading marginal region 96 thereof is positioned to be stapled. As depicted, clamps 100 and 102 move toward one another to secure the stack of copy sheets 98 in position. A suitable solenoid may be employed for moving clamps 100 and 102 toward and away from one another. When clamps 100 and 102 are moved to the clamping position, the stack of copy sheets 98 is secured in the stapling position. At this time, gripper 94 is retracted from the stack of copy sheets 98 and returns under the set of copy sheets 98, as shown by the dashed lines. Stapler 82 is now energized to drive a staple through the leading marginal edge portion 96 of stack 98. Thereafter, clincher 84 moves in an upwardly direction to bend the portion of the staple legs extending through the leading marginal region 96 of stack 98. After the stapling operation is completed, clamps 100 and 102 are retracted and eject rolls 92 energized to advance the stapled booklet 98 to a stacker (not shown) for removal from the printing system by the operator. The foregoing is shown more clearly in FIG. 5.

Figure 5:
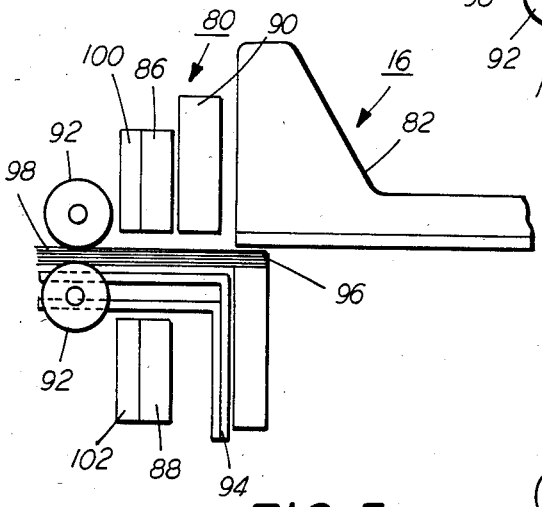
FIG. 5 is a schematic elevational view depicting, in greater detail, the set of sheets being stapled to one another to form a booklet thereof.

As shown in FIG. 5, the staple has been driven through the leading marginal region 96 of stack 98, clincher 84 bends the portion of the staple legs extending through the stack back against the stack to clinch the staple. Clamps 100 and 102 are retracted away from stack 98 and gripper 94 moves under stack 98, to be in a position to receive the next stack of copy sheets. Eject rolls 92 are now energized to forward the stapled stack of copy sheets to the stacker for removal from the printing machine by the operator. Adhesive binding will be described hereinafter with reference to FIGS. 6 and 7.

Figure 6:
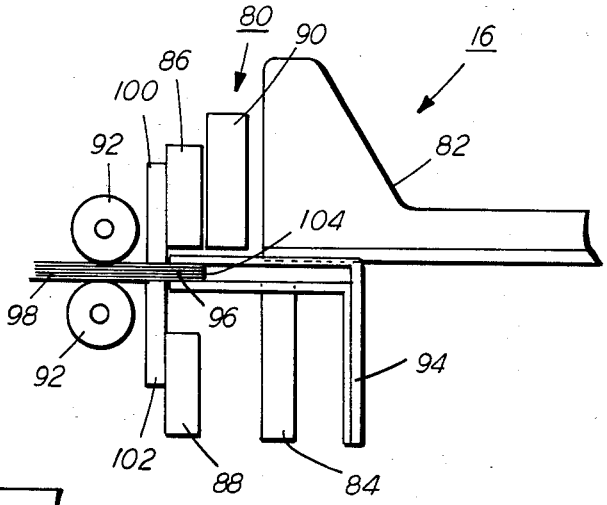
FIG. 6 is an elevational view showing, in greater detail, the set of sheets being transported to the adhesive binder.

Referring now to FIG. 6, gripper 94 advances the leading marginal portion 96 of stack 98 to binding station 80. Clamps 100 and 102 move toward one another to secure stack 98 in the appropriate position for the adhesive binding operation. Gripper 94 now releases the leading marginal region 96 of stack 98 permitting clamps 86 and 88 to be energized moving toward one another so as to clamp the leading marginal portion 96 of stack 98 in the binding position. With binding clamps 100, 102, 86 and 88 fully energized and holding stack 98 firmly in position, gripper 94 moves away therefrom enabling binder and tape holder 90 to move downwardly to the operative position for placing a strip of binding tape on edge 104 of stack 98. Thereafter, binder and tape folder 90 heat the strip of adhesive tape applied to edge 104 so as to melt the adhesive. In this way, the stack of copy sheets 98 is adhesively bound on the leading marginal edge 104 thereof, as shown more clearly in FIG. 7.

Figure 7:
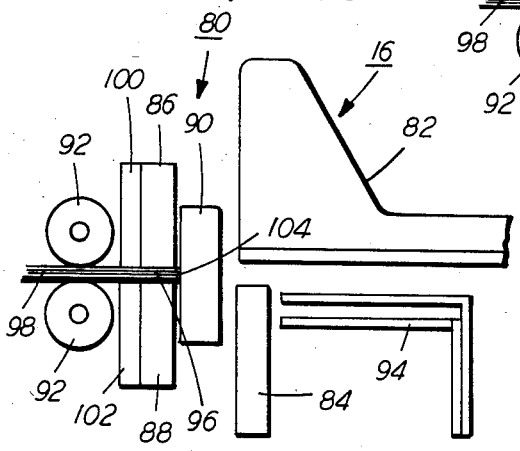
FIG. 7 is an elevational view depicting, in greater detail, the application of heat to melt the adhesive binding for securing the sheets to one another forming a booklet thereof.

Turning now to FIG. 7, gripper 94 is shown fully retracted with binder and tape folder 90 positioned so as to apply heat to the strip of tape placed on leading marginal edge 104 of stack 98. At this time, clamps 100 and 102 firmly hold copy sheet stack 98 in the binding position, while clamps 86 and 88 retract to permit flapping of the binding tape by tape folder 90. Thereafter, clamps 86 and 88 are reclamped to seal the folded tape to the stack of copy sheets. Binder and tape folder 90 may be reciprocated by a solenoid system. Thus, clamps 100, 102, 86 and 88, binder and tape folder 90, and clincher 84 all may be energized by solenoids, as well as, stapler 82. Alternatively, suitable rack and pinion mechanisms may also be employed. Gripper 94 may be moved through its path of travel by a suitable bell crank mechanism or any other slider crank mechanism adaped to produce the desired path of travel. After the adhesive has melted and cured on edge 104 of stack 98, binder and tape folder 90 moves in an upwardly direction away from edge 104. Similarly, clamps 100, 102, 86 and 88 move away from copy sheet stack 98 releasing the stack. Eject rollers 92 are now energized to advance the adhesively bound stack of copy sheets to a stacking tray for removal from the printing machine by the operator.

In recapitulation, the machine operator activates the finishing module on the control panel and selects whether the adhesive binding apparatus, stapling apparatus, or a combination of both are employed. Thereafter, the completed set of copy sheets reproduced by the electrophotographic printing machine is advanced from the compiler tray of the finishing module to the adhesive binder and/or stapling apparatus. Thus, the set of copy sheets may be bound into a booklet by the application of adhesive to the leading marginal edge thereof and/or stapling the sheets together to form a booklet. The resultant booklet is then moved to a stacker tray for removal from the printing machine. In this way, the machine operator may select any of three modes of operation for the finishing module. In one mode of operation, a stack of sheets is adhesively bound, in another mode of operation, the stack of sheets is stapled, and, in the final mode of operation, the stack of sheets may be adhesively bound and stapled to one another. The binding and stapling apparatus of the finishing module are co-linear with the finishing module being on-line.

It is, therefore, evident that there has been provided in accordance with the present invention an apparatus for adhesively binding sheets, stapling sheets, or both adhesively binding and stapling sheets, to form a booklet thereof. This apparatus fully satisfies the aims and advantages hereinbefore set forth. While this invention has been described in conjunction with a perferred embodiment thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus for attaching a plurality of sheets to one another to form a booklet thereof, including:

means for receiving successive sheets to form a set of sheets;

means for stapling the sheets of the set to one another;

means for adhesively binding the sheets of the set to one another with said stapling means and said binding means being co-linear with one another; and means for transporting linearly the set of sheets from said receiving means to either said binding means, or said stapling means, or to both said binding means and said stapling means to form the booklet thereof.

2. An apparatus according to claim 1, wherein said transporting means moves the set of sheets through said binding means before advancing the set of sheets to said stapling means.

3. An apparatus according to claim 2, wherein said transporting means includes means for gripping the leading marginal region of the set of sheets in said receiving means.

4. An apparatus according to claim 3, wherein said gripping means moves the set of sheets from said sheet receiving means to said stapling means and returns to said sheet receiving means during the stapling of the set of sheets thereat.

5. An apparatus according to claim 4, wherein said gripping means moves the set of sheets from said sheet receiving means to said binding means and returns to said sheet receiving means after said binding means adhesively secures the sheets of the set of sheets to one another.

6. A printing system, including:

means for reproducing indicia on successive sheets;

means for advancing at least the sheets having indicia reproduced thereon along a sheet path;

means for receiving the sheets advanced along the sheet path to form a set of sheets;

means for stapling the sheets of the set to one another;

means for adhesively binding the sheets of the set to one another with said stapling means and said binding means being co-linear with one another; and means for transporting linearly the set of sheets from said receiving means to either said binding means, or said stapling means, or to both said binding means and said stapling means to form the booklet thereof.

7. A printing system according to claim 6, wherein said transporting means moves the set of sheets through said binding means before advancing the set of sheets to said stapling means.

8. A printing system according to claim 7, wherein said transporting means includes means for gripping the leading marginal region of the set of sheets in said receiving means.

9. A printing system according to claim 8, wherein said gripping means moves the set of sheets from said sheet receiving means to said stapling means and returns to said sheet receiving means during the stapling of the set of sheets thereat.

10. A printing system according to claim 9, wherein said gripping means moves the set of sheets from said sheet receiving means to said binding means and returns to said sheet receiving means after said binding means adhesively secures the sheets of the set of sheets to one another.

11. A printing system according to claim 10, wherein said reproducing means is an electrophotographic printing machine.

* * * * *